United States Patent [19]

Ackermann et al.

[11] 4,449,258

[45] May 22, 1984

[54] WATER-CLOSET WITH ROTARY DOUBLE PAN

[76] Inventors: Remo Ackermann; Walter Ackermann, both of 6986 Novaggio, Switzerland

[21] Appl. No.: 314,836

[22] PCT Filed: Feb. 24, 1981

[86] PCT No.: PCT/CH81/00021

§ 371 Date: Oct. 22, 1981

§ 102(e) Date: Oct. 22, 1981

[87] PCT Pub. No.: WO81/02436

PCT Pub. Date: Sep. 3, 1981

[51] Int. Cl.[3] ..... E03D 1/00; E03D 3/00; E03D 5/00

[52] U.S. Cl. ..... 4/300; 4/312; 4/467

[58] Field of Search ..... 4/309, 300, 111.1, 111.2, 4/111.3, 111.4, 111.5, 111.6, 467, 441, 340, 341, 342, 420

[56] References Cited

U.S. PATENT DOCUMENTS

| | | | |
|---|---|---|---|
| 652,252 | 6/1900 | Dodge | 4/467 |
| 1,293,141 | 2/1919 | McGary | 4/111.1 |
| 3,436,765 | 4/1969 | Sundberg | 4/111.2 |
| 3,624,843 | 12/1971 | Andrus | 4/111.4 X |
| 3,683,425 | 8/1972 | Patterson | 4/111.4 |
| 3,919,726 | 11/1975 | Godwin et al. | 4/312 |
| 4,112,523 | 9/1978 | Williams | 4/111.5 |
| 4,148,103 | 4/1979 | Nishioka | 4/111.1 |
| 4,183,105 | 1/1980 | Womack | 4/309 |

*Primary Examiner*—Henry K. Artis

*Attorney, Agent, or Firm*—Stevens, Davis, Miller & Mosher

[57] ABSTRACT

A water-closet installation is disclosed, which comprises two pans (2, 2'; 20, 20') inside a housing (10) which pans are fixed to a rotary shaft (W; 27), and which, by rotation of the shaft around 180° are movable into each others position. Hereby the upper pan is lowered after utilization and primary rinsing to be fine-washed, disinfected and dried.

5 Claims, 3 Drawing Figures

FIG. 1
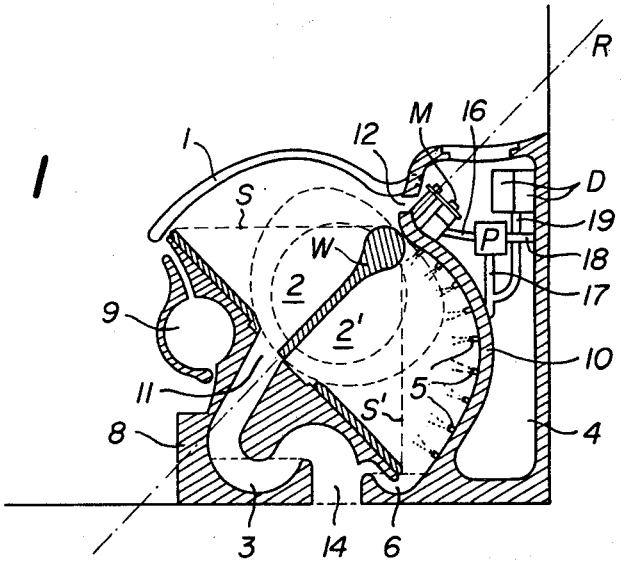
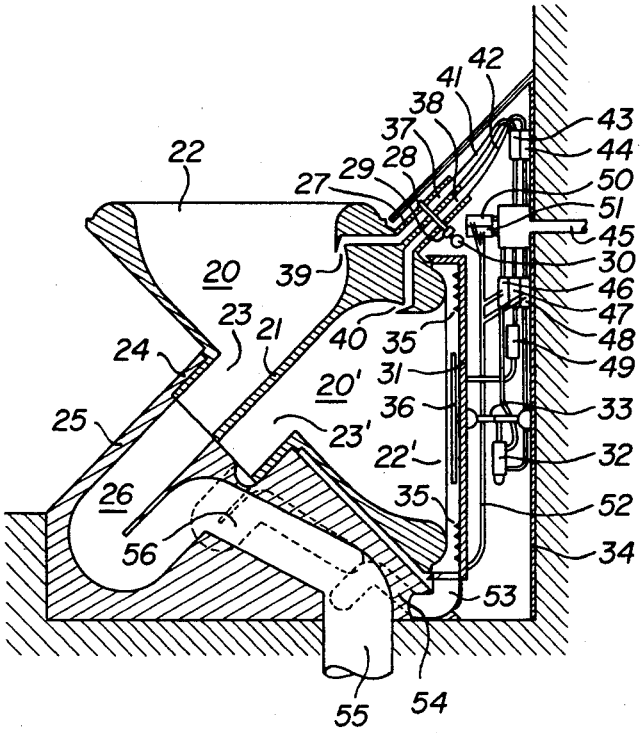
FIG. 2
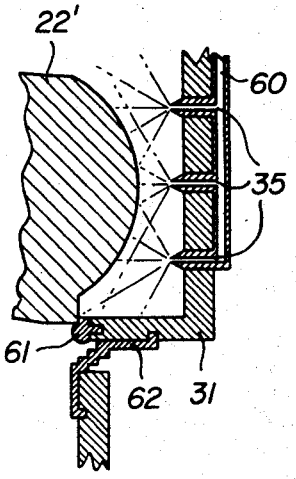
FIG. 3

WATER-CLOSET WITH ROTARY DOUBLE PAN

This invention relates to a water-closet with a water-inlet opening and a lavatory pan arrangement.

In water-closet installations it is known to trigger the rinsing by a key button, whereby the known kind of rinsing cannot wash all parts of the pan, since the pan is not closed entirely. Further it is disadvantageous that during rinsing the lavatory cannot be used.

It is the object of the invention to provide a lavatory installation, in which those parts, which are expected to be absolutely clean may be cleaned and disinfected and be ready for further use immediately.

According to the invention, this object is obtained by a water-closet defined as here-above, whereby the lavatory pan arrangement consists of two essentially identical pans, which are movable into each others position by rotating them around a common axis.

Further details of the invention are explained with reference to constructional examples which are illustrated in the accompanying drawings, in which FIG. 1 shows a sectional view of a water-closet according to the invention, FIG. 2 shows an other embodiment of the invention in the same view, and FIG. 3 shows a detail of FIG. 2 in a larger scale.

FIG. 1 shows a sectional view of a water-closet installation according to the invention which consists of a housing 10 with two pans 2, 2' which are disposed symmetrically in respect to an axis R which is inclined at an angle of 45°. By rotating the pans which are fixed to the shaft W, driven by a motor M, in steps of 180°, each pan can be moved into the position of the other one.

The upper pan which is closed by a cambered cover 1, whose exact shape is determined by the rotation of the pan edges S.

The lower pan, which in respect to the upper one is rotated around 90°—with reference to the drawing-plain and mirror inverted—is washed with spraying water which is sprinkled by nozzles 5.

Between the housing 10 and the wall 15 there is a chamber 4, in which the motor M, a pump P, a container D with chemical agents for the water, such as disinfectants and drying substances and several water-pipes 16–19 are disposed.

The installation works as it is described here-after:

After the use of the lavatory three processes are triggered one after the other by closing the cover or pushing a key button. Firstly a primary rinsing is accomplished by the pump P, which pumps water through the pipe 16 which discharges through the opening 12 into the upper pan 2. The waste water thereby passes from pan 2 through the opening 11 into a siphon 3 which serves as gas separation and which is filled by water, and further into the sink 14. Siphon 3 and sink 14 are disposed in a socle 8. After a predeterminable time the primary rinsing ends, whereafter by powering the motor M the shaft W is driven to rotate about 180°, thereby positioning the lower pan upwards and vice versa. After this the lavatory is free for further use. After rotating the pans the fine cleaning begins for the lowered pan, whereby with a plurality of nozzles 5 water is sprinkled at the lower pan. At the end of this cleaning process a disinfectant and a drying substance may be added to the sprinkling water to firstly obtain absolute hygienic conditions and secondly to speed up the drying period. The sprinkling water is discharged through a secondary siphon 6 into the sink 14 as well.

The rapid drying is important, since the edges S and S' of the pans which are washed as well as the inside of the pans are designed as a seat, and must therefore by dry cleaned and disinfected.

These processes are repeated after every single utilisation.

The pipes 16 and 17 disposed in the chamber 4 lead the water from the pump P to the opening 12 and to the nozzles 5 respectively. The pipe 18 connects the pump with the external water supply and the pipe 19 serves to convey the chemical agents from the container D to the nozzles, whereby the container comprises a dosing device. The lower part of the chamber 4 may also serve as water tank, whereby a tube would have to be provided which extends from the lowest part of the tank to the pump, and whereby the water supply would have to be limited by a float or an electronic indicator.

At the front side of the socle 8, a compartment 9 is provided, which serves for the reception of a paper roll, which may be unrolled through an orifice. The compartment 9 may be opened by swinging the lid around a hinge which is not shown, or it could be accessible at one side, having a security stop for the paper roll.

FIG. 2 shows a vertical sectional view of a preferred embodiment of the invention. In this variant the pan arrangement consists of two pans 20 and 20' which are symmetric to each other in respect to a plane which cuts the partition 21 in perpendicular direction to the drawing-plain. Each of the two pans 20 and 20' comprises an upper edge 22 and 22' which is designed as a seat.

At the lower end of the pans—with respect to the utilisation position—there is a cylindrical exit piece 23, 23' which is divided into two symmetrical parts by the partition 21. The exit piece 23, 23' is rotatable in a counterpart 24, which is part of the socle 25. The socle 25 serves as support for the whole pan arrangement and comprises further the siphon 26. The support 24 is also cylindrical and its inner diameter registers to the outer diameter of the exit piece 23,23', so that the pan arrangement is supported by the socle 25. Between the exit piece and the support there is a gasket (not shown) which seals the inside of the pan arrangement against the outer atmosphere, still allowing rotation of the pans.

The upper ends of the pans are connected with a rotation shaft 27, which carries a spur-gear 28, extending all around the shaft. A rack 29, being connected with an hydraulic cylinder 30 accomplishes an alternating rotation of the shaft 27 and the pan arrangement by 180°, thus performing a reciprocal to and fro swinging of the pans from the upper position into the lower one and back.

The rinsing installation for the lower pan consists substantially of a cover 31 which, driven by a hydraulic cylinder 32, may be retracted into a back position in which it is separated from the lower pan. To accomplish this a toggle joint 33 is fixed to the wall 34 on one side and to the cover on the other. A series of sprinkling nozzles 35 is disposed at the inner side of the cover, as well as a spray strip 36 for sprinkling water to the edges 22' and the inner parts of the pan respectively. The cover bears rubbing strips, having gaskets 61 on their free ends to seal the inside of the lower pan against the outer atmosphere. (Represented in FIG. 3).

The rotation shaft 27 shows two channels 37 and 38 which discharge through openings 39 and 40 into the pans 20 and 20'. These channels are connected with tubes 41 and 42 which on the other ends are connected with electro-magnetic control valves 43 and 44 and further with a schematically drawn distributor 45 for pressurized water, which is provided with a water softening device. The distributor may be connected to a pump or an external water supply, relating to the position of the installation.

Further, the distributor is connected to three electromagnetic control valves 46, 47 and 48, which in turn are connected with the inlet of the hydraulic cylinder 32, a dosing device for the disinfectant and the exit of the hydraulic cylinder 32 respectively.

A water conduit 52 for the relaxation of the hydraulic cylinder 32 is connected with the valves 50, 51, 46 and 48 and leads to the sink 53 at the lower end of the cover 31. This sink is designed as flexible tube, whose length is variable, and it is connected with the exit tube 55 of the siphon 26 by a secondary siphon 54.

A third siphon 56 which discharges also into the sink 55 cooperates with the exit piece 23' of the lower pan, to ensure a complete discharge of the lower pan 20'.

The installation is controlled by a program of a logical control device, which is triggered by an impulse created by a key button. The sequence of the functions is as follows:

opening of valve 43 to begin primary rinsing of pan 20,
closing of valve 43,
opening of valve 46 for supply of cylinder 32 which controls opening of cover 31,
opening of valve 50 for supply of cylinder 30, which causes rotation of pan arrangement,
closing of valve 46,
opening of valve 47, which supplies the cylinder 32 in counter direction to close cover 31,
opening of valve 48 to set going the sprinkling installation which rinses the lower pan,
closing valve 48 at the end of the rinsing procedure,
opening of valve 44 to begin a new primary rinsing of the momentary upper pan 20',
closing of valve 44,
opening of valve 46 (opening of cover 31),
opening of valve 51, which causes counter rotation of pan arrangement in respect of first rotation at the opening of valve 50,
closing of valve 46,
opening of valve 47 (closing of cover 31),
opening of valve 48 (rinsing),
closing of valve 48 (end of rinsing).

FIG. 3 shows an enlarged detail of the lower end of the cover 31, where the nozzles which are supplied from an outwardly disposed tube are arranged. The outer edge of the cover 31 is provided with a gasket 61, whose profile registers with the profile of the cover. To obtain absolute tightness between cover and pan in closed position, flexible bellows are interposed between the cover 31 and the socle 25. These bellows are extensible in order to follow the movement of the cover.

What we claim is:

1. Water-closet having a lavatory pan arrangement, whereby the lavatory pan arrangement consists of two essentially identical pans (2, 2'; 20) which are movable into each others position by rotating them around a common axis (R) each said pan defining a different water inlet and a water and waste exit in each position, both of the pans (2, 2'; 20, 20') being provided with edges (S, 22) which are designed as seats, and each of the edges taking alternatively a horizontal position in which the corresponding pan (2, 20) is ready for utilisation while the other one (2', 20') is exposed to a rinsing installation (5; 35, 36).

2. Water-closet according to claim 1, whereby the rinsing installation comprises at least one nozzle (36), which is connected with a spray water installation (45, 48), in order to wash the lower pan (20') after being lowered.

3. Water-closet according to claim 1, including a rinsing installation comprising a movable, sealing cover (31) on the inner side of which there is disposed at least one nozzle (36), and means to move said cover which in a first position presses the cover tightly against the outer sides of the lower pan (20') and in a second position keeps the cover in a retracted position from the pan, in order to allow its free rotation.

4. Water-closet according to claim 3, whereby said moving means (32, 33) comprise a hydraulic cylinder (32).

5. Water-closet according to claim 3, whereby the cover (31) is provided with a gasket (61), being fitted to the outer side of the pan (20') in order to expose the edge (22') to the nozzles (35) for being washed during the rinsing procedure.

* * * * *